US009277306B2

(12) United States Patent
Raja et al.

(10) Patent No.: US 9,277,306 B2
(45) Date of Patent: Mar. 1, 2016

(54) INTEGRATED SPEAKER ENCLOSURES FOR ELECTRONIC DEVICES

(71) Applicant: Intel Corporation, Santa Clara, CA (US)

(72) Inventors: Kannan G. Raja, Beaverton, OR (US); Nicholas W. Oakley, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 55 days.

(21) Appl. No.: 14/141,852

(22) Filed: Dec. 27, 2013

(65) Prior Publication Data

US 2015/0189415 A1 Jul. 2, 2015

(51) Int. Cl.

| | |
|---|---|
| ***H04R 1/20*** | (2006.01) |
| ***H04R 1/02*** | (2006.01) |
| ***H04R 1/28*** | (2006.01) |

(52) U.S. Cl.

CPC ..... *H04R 1/025* (2013.01); *H04R 1/28* (2013.01); *H04R 2499/11* (2013.01)

(58) Field of Classification Search

CPC ..... H04R 1/28; H04R 1/025; H04R 2499/11

USPC ..... 381/345

See application file for complete search history.

(56) References Cited

U.S. PATENT DOCUMENTS

| | | | | |
|---|---|---|---|---|
| 6,594,472 | B1 * | 7/2003 | Curtis et al. | H04M 1/0283 379/428.01 |
| 8,489,162 | B1 * | 7/2013 | Dou et al. | 455/575.7 |
| 2004/0132511 | A1 * | 7/2004 | Yamamoto | H04M 1/0214 455/575.3 |
| 2008/0316183 | A1 * | 12/2008 | Westerman et al. | 345/173 |
| 2012/0051570 | A1 * | 3/2012 | Arche | H04R 25/554 381/315 |
| 2013/0051595 | A1 * | 2/2013 | Yang et al. | 381/332 |

* cited by examiner

*Primary Examiner* — Matthew Eason
*Assistant Examiner* — Sean H Nguyen
(74) *Attorney, Agent, or Firm* — Blakely, Sokoloff, Taylor & Zafman LLP

(57) ABSTRACT

Integrated speaker enclosures for electronic devices. A device chassis portion with an inner face and an outer face can be connected with a speaker enclosure portion with an inner face, an outer face, and edges. The edges match the inner face of the device chassis portion to provide an audio enclosure when the speaker enclosure portion is aligned with and in contact with the device chassis portion.

14 Claims, 5 Drawing Sheets

INTEGRATED SPEAKER ENCLOSURES FOR ELECTRONIC DEVICES

TECHNICAL FIELD

Embodiments of the invention relate to speakers in electronic devices. More particularly, embodiments of the invention relate to speaker enclosures/boxes for speakers in electronic devices.

BACKGROUND

The design of acoustics and speakers on electronic systems (e.g., smart phones, ULTRABOOKS™, tablets and all-in-ones) are often designed as 'drop-in' solutions that do not fully utilize available internal volume or achieve best/premium audio output. This leads to a compromised audio experience that in inconsistent with the trend for high quality visual experience. Thus, current audio solutions do not provide an optimal user experience. ULTRABOOK™ is a trademark of Intel Corporation in the United States and/or other countries.

BRIEF DESCRIPTION OF THE DRAWINGS

Embodiments of the invention are illustrated by way of example, and not by way of limitation, in the figures of the accompanying drawings in which like reference numerals refer to similar elements.

DETAILED DESCRIPTION

In the following description, numerous specific details are set forth. However, embodiments of the invention may be practiced without these specific details. In other instances, well-known circuits, structures and techniques have not been shown in detail in order not to obscure the understanding of this description.

By utilizing the back-skin (chassis) of a system as one or more sides of the acoustic enclosure with a speaker improved audio performance can be achieved. Further, this can intricately grab internal volume between major system components. As a consequence weight, thickness and overall dimensions of the acoustic module are reduced while grabbing the maximum volume available between system components for acoustic advantage. By combining various chassis materials with acoustic module material (e.g., polyurethane, plastic) better acoustic performance can be achieved. Because a large 'x'-'y' surface is available in case of all-in-one systems, overall vibration is dampened using this approach.

The use of this approach delivers more compact form factors with reduced thickness and/or weight or leverages existing dead system volume for an enhance audio experience. Vibration (while playing high Sound Pressure Levels) is absorbed into the chassis, which acts as a damper. The embodiments and strategies described can be used in any form factor—especially in smaller form factor devices like smartphones, tablets or ULTRABOOKS™ where available volume for acoustic module is very limited. By using these embodiments, potential increase in acoustic volume could be achieved without impacting overall system volume.

The examples that follow in FIGS. 1A, 1B, 2A, 2B, 3A and 3B illustrate only a portion of a chassis for an electronic device and none of the electronics. This is for reasons of simplicity as any type of electronic device having speakers can be enclosed in the chassis. For example, the electronic device can be a desktop computer system, a laptop computer system, an ULTRABOOK™, a tablet, a smartphone, a mobile audio device, a portable television, or a video playback device. An example block diagram of an electronic device is provided in FIG. 4. The techniques described herein are also applicable to non-electronic applications as well, for example, furniture, wireless speakers, automobiles, headphones, etc.

Further, the examples of FIGS. 1A, 1B, 2A, 2B, 3A and 3B illustrate a rear chassis portion being utilized with a speaker enclosure portion to provide an audio enclosure. This is but one example embodiment. Other examples can utilize a front chassis portion in a similar manner. Other examples can include side chassis portions. As discussed above use of the speaker enclosure portion with a chassis allows for a greater audio enclosure volume than use of a complete speaker enclosure housed within the chassis.

Figure 1A:
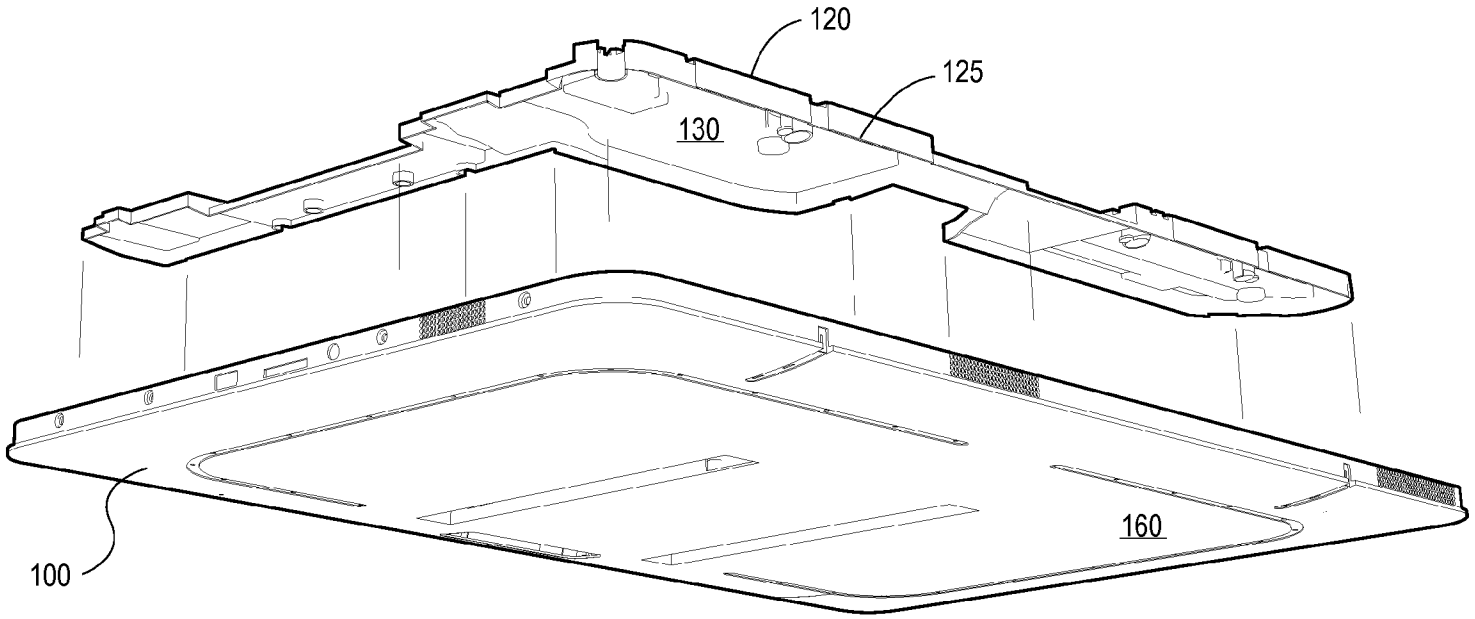
FIG. 1A is a perspective-view illustration of a backside chassis portion and a partial speaker enclosure.

FIG. 1A is a perspective-view illustration of an outer view of a backside chassis portion and a partial speaker enclosure. In the example of FIG. 1A, chassis portion 100 and speaker enclosure portion 120 operate to form an audio enclosure. Chassis portion 100 can be, for example, a lower portion of a laptop computer chassis, or chassis portion 100 can be a back portion of a tablet chassis. An upper chassis portion or an upper chassis portion (not illustrated in FIG. 1A) can be connected with chassis portion 100 to provide an enclosure for an electrical system.

Edges 125 of speaker enclosure section 120 engage with, or meet with, an inner surface of chassis portion 100. Thus, inner surface 130 of speaker enclosure 120 becomes an inner surface of the resulting audio enclosure. Outer surface 160 of chassis portion 100 can include any features useful for the electronic device, for example, rubber feet, cooling features, etc.

Figure 1B:
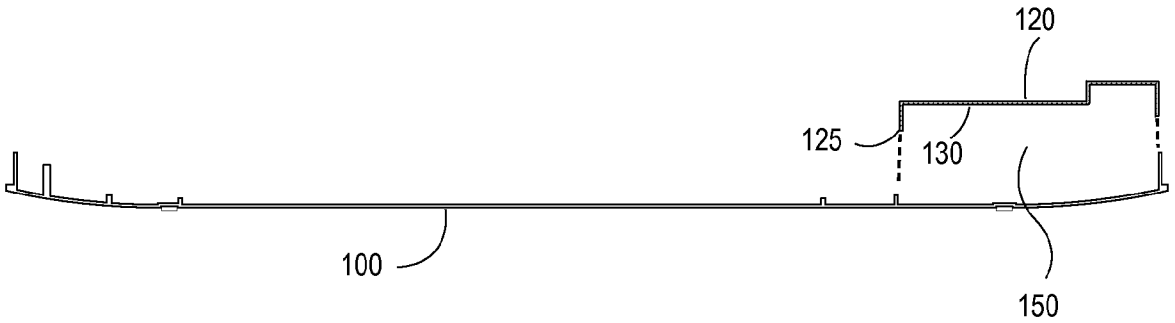
FIG. 1B is a split side view illustration of the backside chassis portion and partial speaker enclosure of FIG. 1A.

FIG. 1B is a split side view illustration of the backside chassis portion and a partial speaker enclosure of FIG. 1A. FIG. 1B illustrates alignment between chassis portion 100 and speaker enclosure section 120, which form audio enclosure 150 when engaged.

Figure 2A:
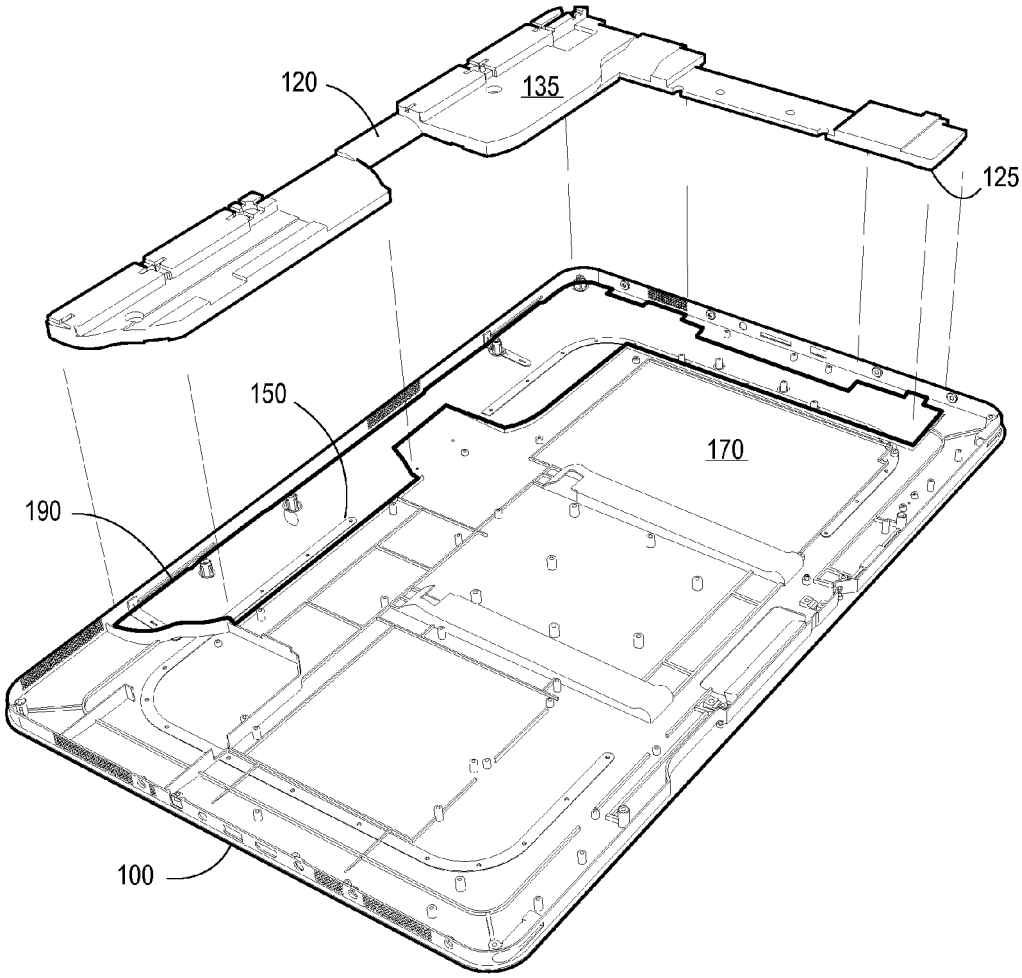
FIG. 2A is a perspective-view illustration of the backside chassis portion and partial speaker enclosure illustrating alignment.

FIG. 2A is a perspective-view illustration of an inner view of the backside chassis portion and partial speaker enclosure illustrating alignment. In FIG. 2A, line 190 indicates where edges 125 of speaker enclosure section 120 meet with chassis portion 100 to form audio enclosure 150 when speaker enclosure 120 and chassis portion 100 are connected. Inner surface 170 of chassis portion inside line 190 operates as the other "half" of the speaker enclosure made with speaker enclosure section 120. In traditional designs a complete box with a counterpart enclosure section would be placed within chassis portion 100, which would result in a less efficient system design.

Figure 2B:
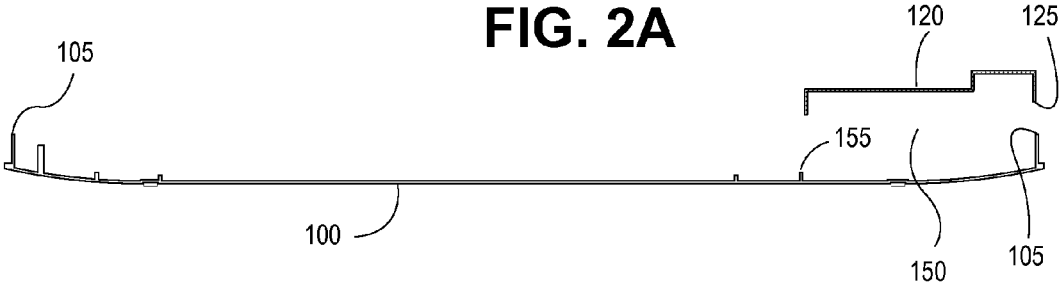
FIG. 2B is a split side view illustration of the backside chassis portion and partial speaker enclosure of FIG. 2A.

FIG. 2B is a split side view illustration of the backside chassis portion and partial speaker enclosure of FIG. 2A. In one embodiment, chassis portion 100 can include edges, or lips, 105 for alignment with a counterpart chassis portion (not shown) and/or to provide edges or depth to the system enclosure. In one embodiment, edges 105 have holes to allow sound or heat to escape the system enclosure. In other embodiments, chassis portion and/or other chassis elements can have holes to allow sound and/or heat to escape.

In one embodiment, chassis portion 100 includes audio enclosure edges 155 for alignment with and/or placement of speaker enclosure section 120. In one embodiment, edges 125 of speaker enclosure section 120 fit within audio enclosure edges 155 and chassis portion edge 105.

Figure 3A:
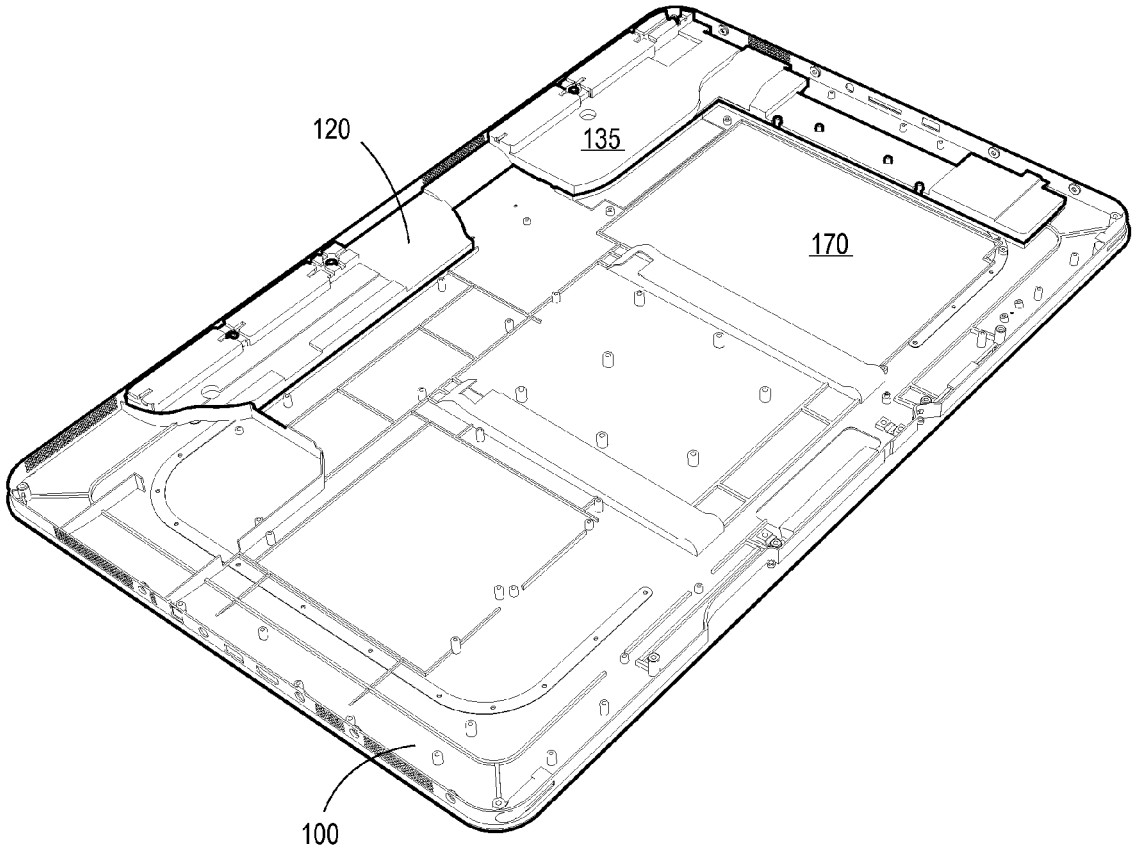
FIG. 3A is a perspective-view illustration of the backside chassis portion and the partial speaker enclosure aligned and attached to form an audio enclosure.
Figure 3B:
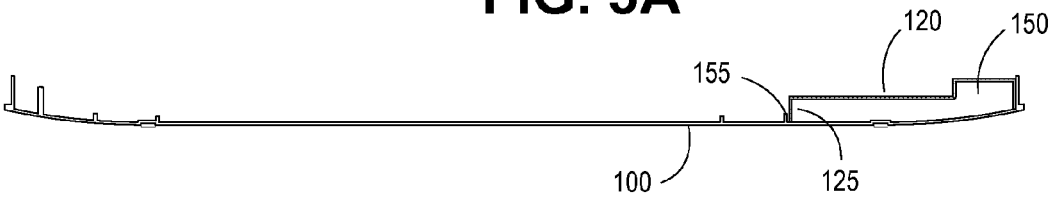
FIG. 3B is a split side view illustration of the backside chassis portion and the partial speaker enclosure aligned and attached to form the audio enclosure.

FIG. 3A is a perspective-view illustration of the backside chassis portion and the partial speaker enclosure aligned and attached to form an audio enclosure. FIG. 3A illustrates chassis portion 100 engaged with speaker enclosure section 120. Various mechanisms can be utilized to hold chassis portion 100 and speaker enclosure section 120 together, for example, screws, clips, adhesive or any combination thereof. FIG. 3B is a split side view illustration of the backside chassis portion and the partial speaker enclosure aligned and attached to form the audio enclosure.

Audio enclosure 150 can be tuned in any manner known in the art. For example, the shape of various portions of chassis portion and/or speaker enclosure section 120 can be designed to give the desired audio performance.

Figure 4:
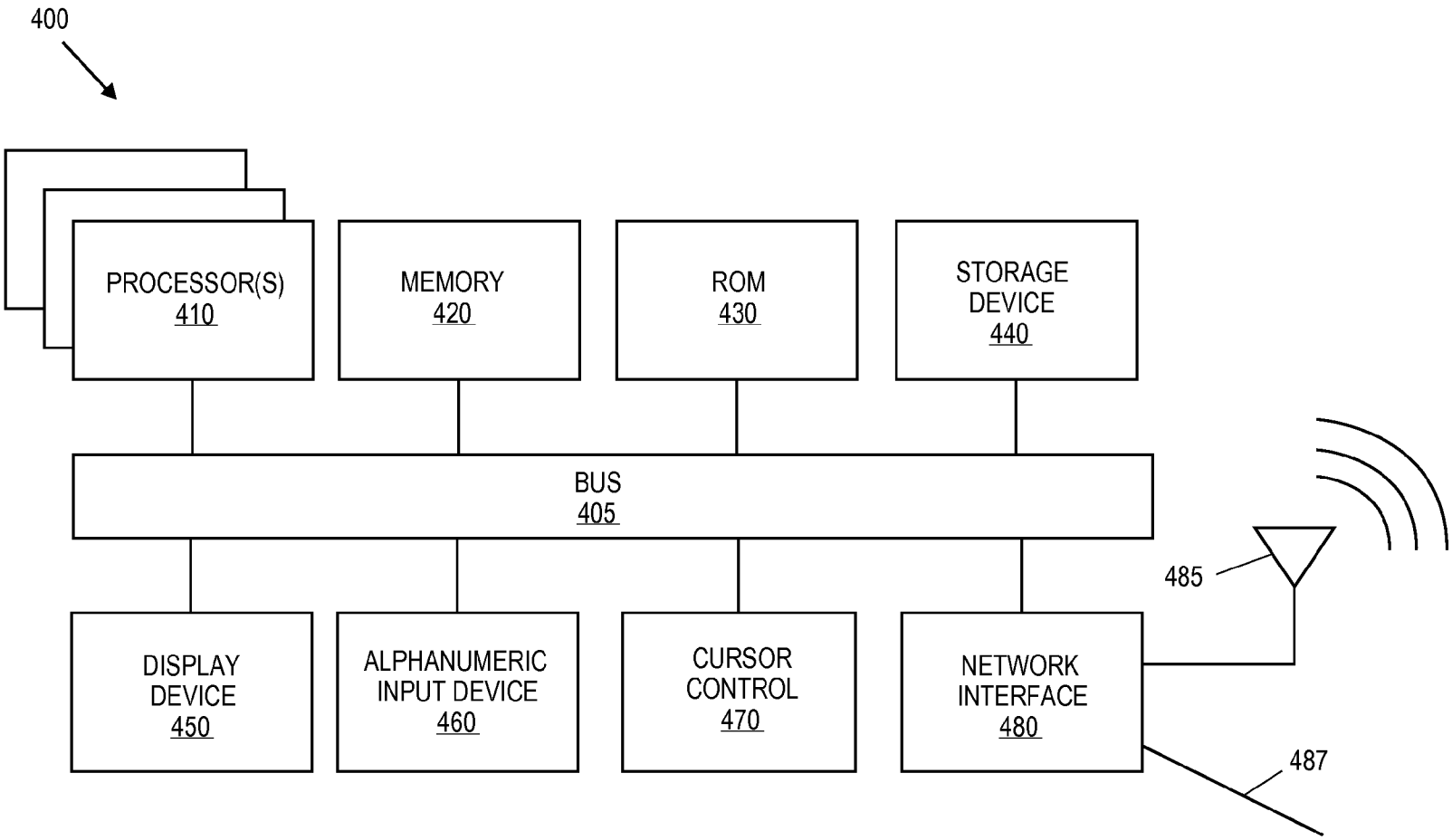
FIG. 4 is a block diagram of one embodiment of an electronic system that can incorporate one or more speaker enclosures as described herein.

FIG. 4 is a block diagram of one embodiment of an electronic system that can incorporate one or more speaker enclosures as described herein. The electronic system illustrated in FIG. 4 is intended to represent a range of electronic systems (either wired or wireless) including, for example, desktop computer systems, laptop computer systems, ULTRABOOKS™, cellular telephones, personal digital assistants (PDAs) including cellular-enabled PDAs, set top boxes, tablets, etc. Alternative electronic systems may include more, fewer and/or different components.

Electronic system 400 includes bus 405 or other communication device to communicate information, and processor 410 coupled to bus 405 that may process information. While electronic system 400 is illustrated with a single processor, electronic system 400 may include multiple processors and/or co-processors. Electronic system 400 further may include random access memory (RAM) or other dynamic storage device 420 (referred to as main memory), coupled to bus 405 and may store information and instructions that may be executed by processor 410. Main memory 420 may also be used to store temporary variables or other intermediate information during execution of instructions by processor 410.

Electronic system 400 may also include read only memory (ROM) and/or other static storage device 430 coupled to bus 405 that may store static information and instructions for processor 410. Data storage device 440 may be coupled to bus 405 to store information and instructions. Data storage device 440 such as a magnetic disk or optical disc and corresponding drive may be coupled to electronic system 400.

Electronic system 400 may also be coupled via bus 405 to display device 450, such as a cathode ray tube (CRT) or liquid crystal display (LCD), to display information to a user. Alphanumeric input device 460, including alphanumeric and other keys, may be coupled to bus 405 to communicate information and command selections to processor 410. Another type of user input device is cursor control 470, such as a mouse, a trackball, or cursor direction keys to communicate direction information and command selections to processor 410 and to control cursor movement on display 450.

Electronic system 400 further may include network interface(s) 480 to provide access to a network, such as a local area network. Network interface(s) 480 may include, for example, a wireless network interface having antenna 485, which may represent one or more antenna(e). Network interface(s) 480 may also include, for example, a wired network interface to communicate with remote devices via network cable 487, which may be, for example, an Ethernet cable, a coaxial cable, a fiber optic cable, a serial cable, or a parallel cable.

In one embodiment, network interface(s) 480 may provide access to a local area network, for example, by conforming to IEEE 802.11b and/or IEEE 802.11g standards, and/or the wireless network interface may provide access to a personal area network, for example, by conforming to Bluetooth standards. Other wireless network interfaces and/or protocols can also be supported.

IEEE 802.11b corresponds to IEEE Std. 802.11b-1999 entitled "Local and Metropolitan Area Networks, Part 11: Wireless LAN Medium Access Control (MAC) and Physical Layer (PHY) Specifications: Higher-Speed Physical Layer Extension in the 2.4 GHz Band," approved Sep. 16, 1999 as well as related documents. IEEE 802.11g corresponds to IEEE Std. 802.11g-2003 entitled "Local and Metropolitan Area Networks, Part 11: Wireless LAN Medium Access Control (MAC) and Physical Layer (PHY) Specifications, Amendment 4: Further Higher Rate Extension in the 2.4 GHz Band," approved Jun. 27, 2003 as well as related documents. Bluetooth protocols are described in "Specification of the Bluetooth System: Core, Version 1.1," published Feb. 22, 2001 by the Bluetooth Special Interest Group, Inc. Associated as well as previous or subsequent versions of the Bluetooth standard may also be supported.

In addition to, or instead of, communication via wireless LAN standards, network interface(s) 480 may provide wireless communications using, for example, Time Division, Multiple Access (TDMA) protocols, Global System for Mobile Communications (GSM) protocols, Code Division, Multiple Access (CDMA) protocols, and/or any other type of wireless communications protocol.

Figure 5:
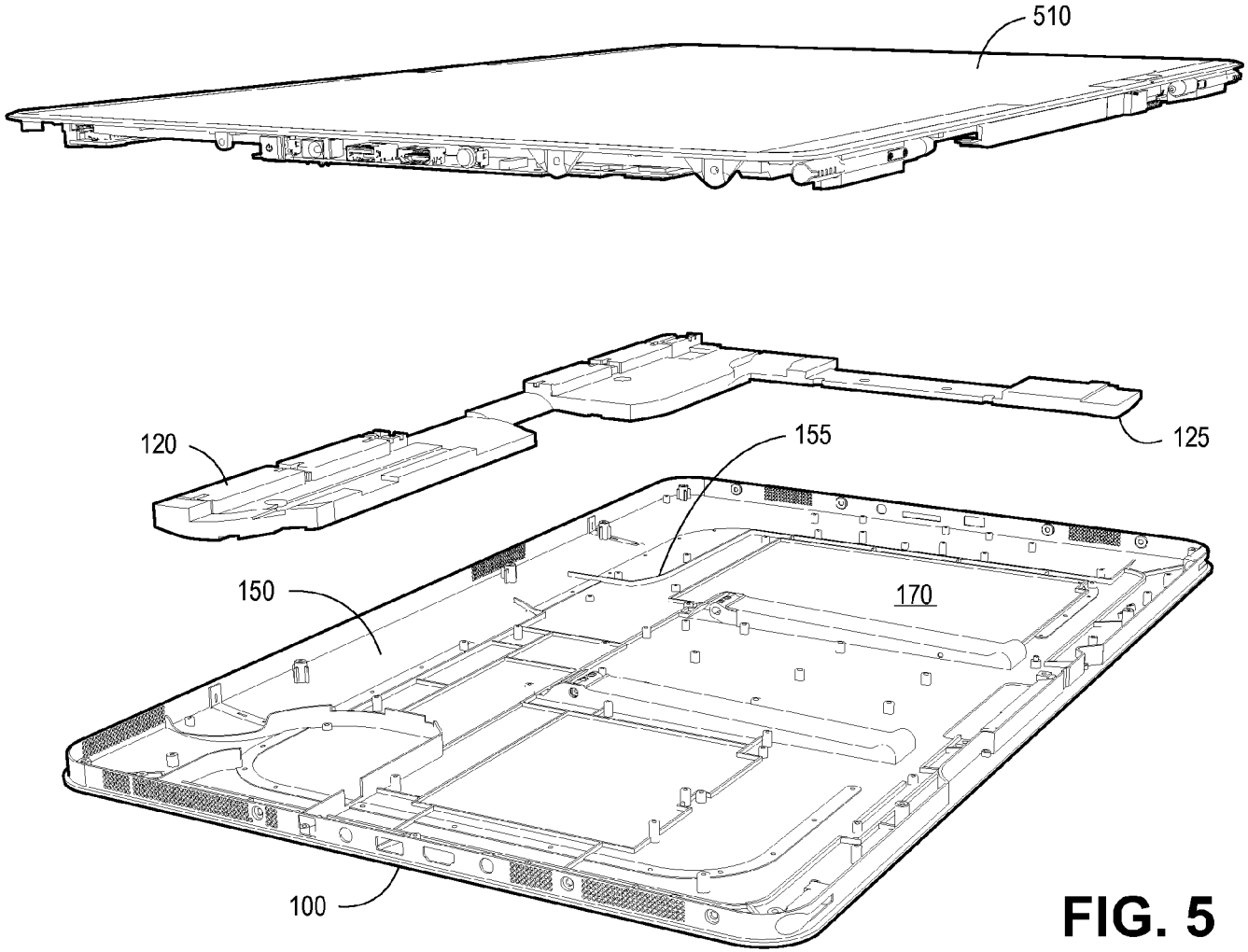
FIG. 5 is an illustration of a tablet/mobile computing device having front and back chassis portions with a partial speaker enclosure to form the audio enclosure.

FIG. 5 is an illustration of a tablet/mobile computing device having front and back chassis portions with a partial speaker enclosure to form the audio enclosure. The example of FIG. 5 provides an illustration of a top (or front) chassis portion to connect with the chassis portion illustrated in FIGS. 1A, 1B 2A, 2B, 3A and 3C. In one embodiment, the electronic system of FIG. 4 and the audio enclosure may be housed in the chassis illustrated in FIG. 5.

In one embodiment, front chassis portion 510 includes at least a touchscreen interface for a tablet computing device. Front chassis portion 510 may also include other components of the system, for example, sensors, cameras, input/output (I/O) ports, one or more antennae, etc. As another example, top chassis portion 510 can include a keyboard and/or a track pad for interacting with a mobile computing device. Top chassis portion 510 may also include other components of the system, for example, sensors, cameras, input/output (I/O) ports, one or more antennae, etc.

In one embodiment, a device chassis portion with an inner face and an outer face can be connected with a speaker enclosure portion with an inner face, an outer face, and edges. The edges match the inner face of the device chassis portion to provide an audio enclosure when the speaker enclosure portion is aligned with and in contact with the device chassis portion.

In one embodiment, one or more speakers can be at least partially within the audio enclosure. In one embodiment, the device chassis portion includes a lip to engage the edges of the speaker enclosure portion. In one embodiment, an upper enclosure portion can connect with the device chassis portion that, when connected together enclose the speaker enclosure portion and one or more electronic components.

In one embodiment, a tablet device includes a rear chassis portion with an inner face and an outer face can be connected with a speaker enclosure portion with an inner face, an outer face, and edges. The edges match the inner face of the rear chassis portion to provide an audio enclosure when the speaker enclosure portion is aligned with and in contact with the rear chassis portion.

In one embodiment, one or more speakers can be at least partially within the audio enclosure. In one embodiment, the rear chassis portion includes a lip to engage the edges of the speaker enclosure portion. In one embodiment, an upper enclosure portion can connect with the rear chassis portion that, when connected together enclose the speaker enclosure portion and one or more electronic components.

In one embodiment, the front chassis portion includes at least a touch screen interface. In one embodiment, the front chassis portion comprises at least one antenna.

In one embodiment, a mobile computing device includes a lower chassis portion with an inner face and an outer face can be connected with a speaker enclosure portion with an inner face, an outer face, and edges. The edges match the inner face of the lower chassis portion to provide an audio enclosure when the speaker enclosure portion is aligned with and in contact with the lower chassis portion.

In one embodiment, one or more speakers can be at least partially within the audio enclosure. In one embodiment, the lower chassis portion includes a lip to engage the edges of the speaker enclosure portion. In one embodiment, an upper enclosure portion can connect with the lower chassis portion that, when connected together enclose the speaker enclosure portion and one or more electronic components.

In one embodiment, the upper chassis portion includes at least a keyboard interface. In one embodiment, the upper chassis portion includes at least a trackpad interface. In one embodiment, the front chassis portion includes at least one antenna.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

While the invention has been described in terms of several embodiments, those skilled in the art will recognize that the invention is not limited to the embodiments described, but can be practiced with modification and alteration within the spirit and scope of the appended claims. The description is thus to be regarded as illustrative instead of limiting.

What is claimed is:

1. An apparatus comprising:

a lower chassis portion having an inner face and an outer face;

a partial speaker enclosure portion having an inner face, an outer face, and edges, the edges to match the inner face of the lower chassis portion to provide an audio enclosure when the partial speaker enclosure portion is aligned with and in contact with the lower chassis portion; and an upper chassis portion to connect with the lower chassis portion;

wherein the lower chassis portion further comprises:

an audio enclosure edge to engage an edge of the partial speaker enclosure portion, the audio enclosure edge being located on the inner face of the lower chassis portion, and a chassis portion edge located on an outer portion of the lower chassis portion, the edges of the partial speaker enclosure portion to fit within the audio enclosure edge and the chassis portion edge; and wherein, upon the partial speaker enclosure portion being aligned with and in contact with the lower chassis portion and upon the upper chassis portion and lower chassis portion being connected together, the upper chassis portion and lower chassis portion are to enclose the partial speaker enclosure portion and one or more electronic components.

2. The apparatus of claim 1, further comprising one or more speakers located within the audio enclosure.

3. The apparatus of claim 1, wherein the partial speaker enclosure portion is constructed of acoustic module material.

4. The apparatus of claim 3 wherein the acoustic module material includes one or more of polyurethane or plastic.

5. The apparatus of claim 1, wherein the chassis portion edge includes a plurality of holes to allow escape of sound and heat from the apparatus.

6. A tablet device comprising:

a rear chassis portion having an inner face and an outer face;

a partial speaker enclosure portion having an inner face, an outer face, and edges, the edges to match the inner face of the rear chassis portion to provide an audio enclosure when the partial speaker enclosure portion is aligned with and in contact with the rear chassis portion; and a front chassis portion to connect with the rear chassis portion;

wherein the rear chassis portion further comprises:

an audio enclosure edge to engage an edge of the partial speaker enclosure portion, the audio enclosure edge being located on the inner face of the rear chassis portion, and a chassis portion edge located on an outer portion of the rear chassis portion, the edges of the partial speaker enclosure portion to fit within the audio enclosure edge and the chassis portion edge; and wherein, upon the partial speaker enclosure portion being aligned with and in contact with the rear chassis portion and upon the front chassis portion and rear chassis portion being connected together, the front chassis portion and lower chassis portion are to enclose the partial speaker enclosure portion and one or more electronic components.

7. The tablet device of claim 6, further comprising one or more speakers located within the audio enclosure.

8. The tablet device of claim 6, wherein the front chassis portion comprises at least a touch screen interface.

9. The tablet device of claim 6, wherein the front chassis portion comprises at least one antenna.

10. A mobile computing device comprising:

a lower chassis portion having an inner face and an outer face;

a partial speaker enclosure portion having an inner face, an outer face, and edges, the edges to match the inner face of the lower chassis portion to provide an audio enclosure when the partial speaker enclosure portion is aligned with and in contact with the lower chassis portion; and an upper chassis portion to connect with the lower chassis portion;

wherein the lower chassis portion further comprises:

an audio enclosure edge to engage an edge of the partial speaker enclosure portion, the audio enclosure edge being located on the inner face of the lower chassis portion, and a chassis portion edge located on an outer portion of the lower chassis portion, the edges of the partial speaker enclosure portion to fit within the audio enclosure edge and the chassis portion edge; and wherein, upon the partial speaker enclosure portion being aligned with and in contact with the lower chassis portion and upon the upper chassis portion and lower chassis portion being connected together, the upper chassis portion and lower chassis portion are to enclose the partial speaker enclosure portion and one or more electronic components.

11. The mobile computing device of claim 10, further comprising one or more speakers located within the audio enclosure.

12. The mobile computing device of claim 10, wherein the upper chassis portion comprises at least a keyboard interface.

13. The mobile computing device of claim 10, wherein the upper chassis portion comprises at least a trackpad interface.

14. The mobile computing device of claim 10, wherein the partial chassis portion comprises at least one antenna.

* * * * *